US008210622B2

(12) United States Patent
Forrest et al.

(10) Patent No.: US 8,210,622 B2
(45) Date of Patent: Jul. 3, 2012

(54) ADJUSTABLE PRODUCT DISPLAY ASSEMBLY

(75) Inventors: Earl David Forrest, Asheboro, NC (US); James Leroy Daniels, Stokesdale, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 396 days.

(21) Appl. No.: 12/403,641

(22) Filed: Mar. 13, 2009

(65) Prior Publication Data

US 2010/0231099 A1 Sep. 16, 2010

(51) Int. Cl.
*A47B 88/00* (2006.01)

(52) U.S. Cl. ..... 312/330.1; 312/348.3; 211/184

(58) Field of Classification Search ..... 312/330.1, 312/348.3, 257.1; 108/60, 61; 211/184; 248/222.51, 222.52; 220/553, 529, 532, 220/533

See application file for complete search history.

(56) References Cited

U.S. PATENT DOCUMENTS

| | | | | |
|---|---|---|---|---|
| 943,719 | A | 12/1909 | Vick | |
| 1,318,306 | A | 10/1919 | Walker | |
| 1,656,868 | A | 1/1928 | Davis et al. | |
| 1,757,141 | A | 5/1930 | Raster | |
| 2,014,516 | A | 9/1935 | Beddingfield | |
| 2,081,078 | A * | 5/1937 | Watson | 126/373.1 |
| 2,257,536 | A * | 9/1941 | Roycroft | 211/126.1 |
| 2,788,912 | A * | 4/1957 | Simonsen | 220/533 |
| 2,868,391 | A | 1/1959 | Sides | |
| 2,985,333 | A * | 5/1961 | Kirkman | 220/533 |
| 2,998,128 | A | 8/1961 | Larson | |
| 3,032,381 | A | 5/1962 | Boro | |
| 3,097,746 | A * | 7/1963 | Handler et al. | 211/133.3 |
| 3,200,983 | A | 8/1965 | Walter | |
| 3,227,504 | A | 1/1966 | Dunham | |
| 3,770,333 | A | 11/1973 | Cusker | |
| 3,807,572 | A * | 4/1974 | Luvara et al. | 211/10 |
| 3,905,484 | A * | 9/1975 | Dean et al. | 211/184 |
| 4,073,554 | A * | 2/1978 | Oder et al. | 312/199 |
| 4,366,904 | A * | 1/1983 | Roskvist | 206/425 |
| 4,372,444 | A * | 2/1983 | Le Grand et al. | 206/505 |
| 4,436,215 | A | 3/1984 | Kleinert et al. | |
| 4,446,982 | A * | 5/1984 | Corse | 220/8 |
| 4,448,307 | A | 5/1984 | Roggenkamp | |
| 4,577,773 | A | 3/1986 | Bitel | |
| 4,624,509 | A | 11/1986 | Ramsey | |
| 4,776,477 | A * | 10/1988 | Walker | 220/4.28 |
| 4,807,760 | A | 2/1989 | Sussman | |
| 4,828,133 | A | 5/1989 | Hougendobler | |

(Continued)

FOREIGN PATENT DOCUMENTS

CA 2633605 A1 * 11/2009

*Primary Examiner* — Korie Chan

(74) *Attorney, Agent, or Firm* — Carlson, Gaskey & Olds P.C.

(57) ABSTRACT

An example configurable display assembly includes a housing having a first wall, an opposing second wall, and at least one divider movable between an engaged position and a disengaged position. The divider spans from the first wall to the second wall when in the engaged position. At least one of the housing or the divider flexes to establish clearance for moving the divider to the engaged position. The housing and the divider establish at least one first bin receiving area when the divider is in the engaged position. The housing establishes a second bin receiving area when the divider is in the disengaged position. The second bin receiving area is larger than the first bin receiving area.

13 Claims, 3 Drawing Sheets

U.S. PATENT DOCUMENTS

| | | | | | |
|---|---|---|---|---|---|
| 4,944,544 | A | | 7/1990 | Dick | |
| 5,082,139 | A | | 1/1992 | Quam | |
| 5,085,328 | A | * | 2/1992 | Evenson | 211/55 |
| 5,150,809 | A | | 9/1992 | Leigh | |
| 5,215,205 | A | | 6/1993 | Behlman | |
| 5,394,305 | A | * | 2/1995 | Moral et al. | 361/796 |
| 5,435,255 | A | * | 7/1995 | Elseser et al. | 109/56 |
| 5,594,207 | A | | 1/1997 | Fabian et al. | |
| 5,664,856 | A | * | 9/1997 | Pacetti | 312/348.3 |
| 6,149,040 | A | | 11/2000 | Walker | |
| 6,196,401 | B1 | * | 3/2001 | Brady et al. | 211/186 |
| 7,128,379 | B1 | * | 10/2006 | LaBonia et al. | 312/351 |
| 7,452,039 | B1 | * | 11/2008 | Golias et al. | 312/257.1 |
| 7,654,408 | B2 | * | 2/2010 | Bazany | 220/533 |
| 2006/0108301 | A1 | * | 5/2006 | Polvere et al. | 211/72 |

* cited by examiner

ADJUSTABLE PRODUCT DISPLAY ASSEMBLY

BACKGROUND

This application relates generally to a display assembly that can be configured to accommodate different sizes of individual product display bins.

As known, display assemblies are used to hold products in many different establishments. Retail establishments, for example, often utilize display assemblies to hold pulls, handles, and other types of hardware products. A single display assembly typically includes multiple individual display bins that each hold a particular type of product. As known, sales of products fluctuate over time. Accordingly, the retail establishment may desire to adjust the amount and types of products displayed within their single display assemblies.

In some prior art examples, the retail establishment devotes additional bins within a display assembly to displaying a particular product as demand for that product increases. However, placing the same product into multiple separate bins within the display assembly tends to confuse and frustrate the customer, which can reduce sales. In other examples, the display assembly is reconfigured to accommodate larger bins for the product as demand for the product increases. Existing approaches to reconfiguring the display assembly are time consuming and involve substantial modifications to the display assembly.

SUMMARY OF THE INVENTION

An example configurable display assembly includes a housing having a first wall, an opposing second wall, and at least one divider movable between an engaged position and a disengaged position. The divider spans from the first wall to the second wall when in the engaged position. At least one of the housing or the divider flexes to establish clearance for moving the divider to the engaged position. The housing and the divider establish at least one first bin receiving area when the divider is in the engaged position. The housing establishes a second bin receiving area when the divider is in the disengaged position. The second bin receiving area is larger than the first bin receiving area.

An example method of installing a display bin divider includes inserting a first end of a divider into an aperture established in a first wall of a display bin and then rotating the divider relative to the first wall about the first end. A second wall of the display bin is then flexed away from the first wall to provide clearance for moving at least one tab on an opposing second end of the divider into a position for insertion into a corresponding aperture in the second wall.

These and other features of the present invention can be best understood from the following specification and drawings, the following of which is a brief description.

DETAILED DESCRIPTION

Figure 1:
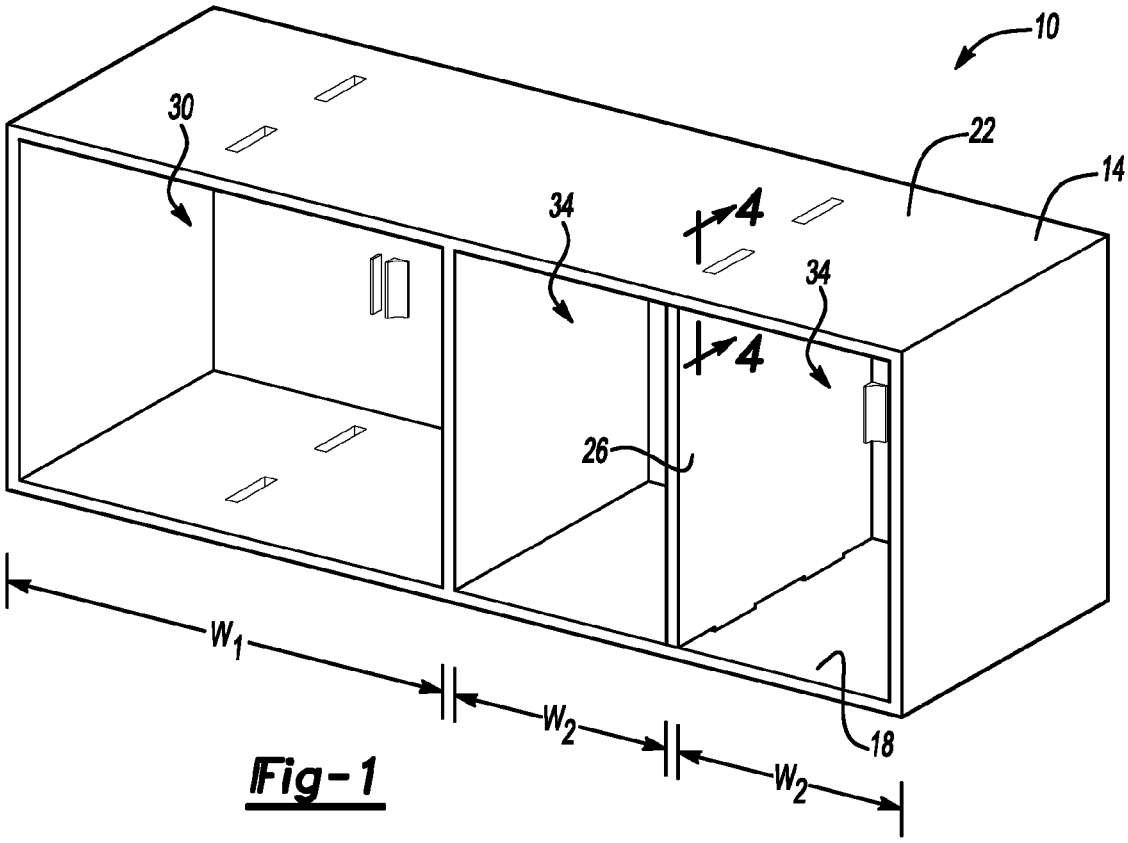
FIG. 1 shows a perspective view of the example configurable display assembly with individual display bins removed and having a divider in an engaged position.
Figure 2:
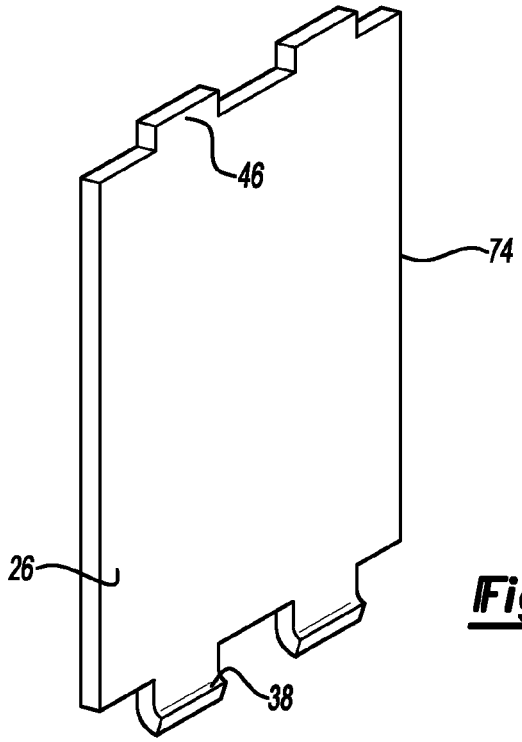
FIG. 2 shows a perspective view of the FIG. 1 divider in a disengaged position.
Figure 3:
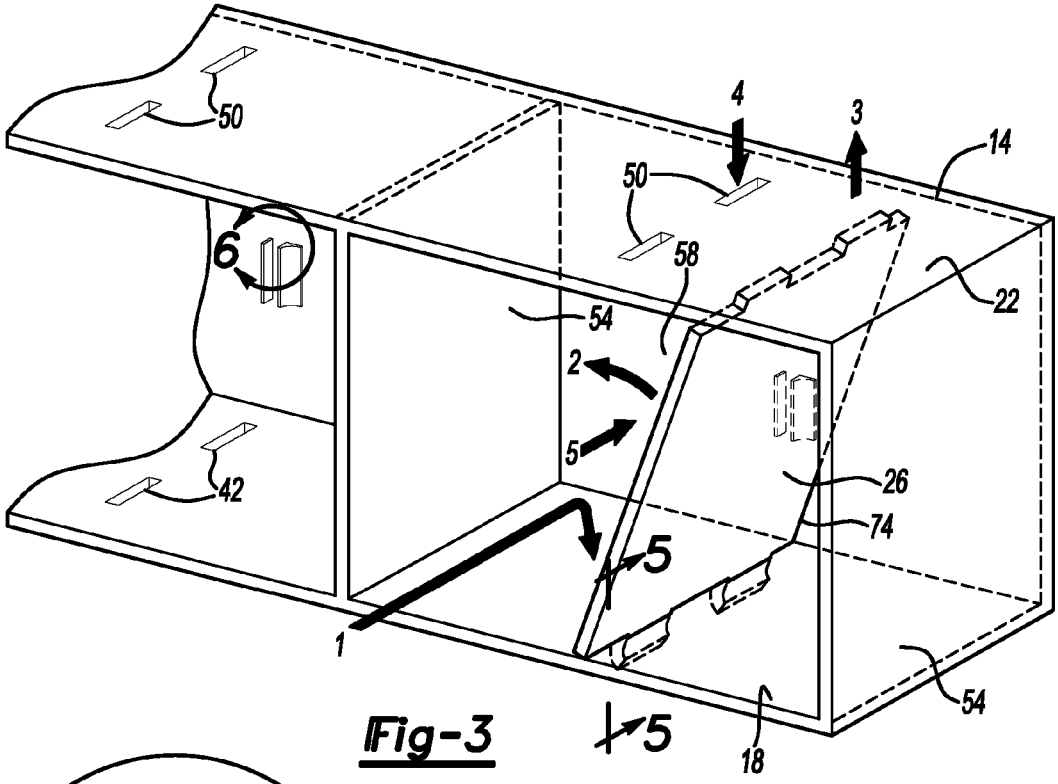
FIG. 3 shows a partial view of the FIG. 1 display assembly with the divider shown in an installing position.

Referring to FIG. 1, an example configurable display bin assembly 10 includes a housing 14 having a first wall 18 and an opposing second wall 22. At least one divider 26 is moveable between an engaged position and a disengaged position with the housing 14.

In this example, the housing 14 of the display bin assembly 10 establishes a first bin receiving area 30 having a width $W_1$. The housing 14 and the divider 26 establish two second bin receiving areas 34 each having widths $W_2$, which, in this example, is approximately half the width $W_1$. The bin receiving area 30 is able to accommodate a wider display bin than each of the bin receiving areas 34. As can be appreciated, moving a second divider (not shown) to an engaged position within the first bin receiving area 30 would divide the first bin receiving area 30 into two smaller bin receiving areas having widths $W_2$.

Referring now to FIGS. 2-6, a first end of the divider 26 includes an alignment feature, which is a plurality of curved extensions 38 in this example. The first wall 18 establishes at least one aperture 42 sized to receive a corresponding one of the curved extensions 38. A second end of the divider 26 includes an engagement feature, which is a plurality of tabs 46 in this example. The second wall 22 establishes at least one aperture 50 sized to receive a corresponding one of the tabs 46. In this example, the divider 26 is in the engaged position when the curved extensions 38 are received within the apertures 42 and the tabs 46 are received within the apertures 50. The first end of the divider 26 and the second end define a length of the divider 26 therebetween.

The divider 26 is in installing positions as the divider 26 moves between the engaged position and the disengaged position. The installing positions, in this example, include moving the divider 26 along path 1 to a position between the first wall 18 and the second wall 22. The divider 26 is inserted at an angle θ relative to the first wall 18 that is less than 90° in this example. Angling the example divider 26 relative to the first wall 18 prevents a leading edge of the second wall 22 from contacting the tabs 46 or a leading edge of the first wall 18 from contacting the curved extension 38 as the divider 26 moves in direction 1, which would block further movement of the divider 26. Moving the divider 26 along this path results in the apertures 42 receiving the corresponding curved extensions 38. Because the curved extensions 38 are curved, the apertures 42 able to receive the curved extensions 38 even though the remaining portions of the divider 26 are angled relative to the first wall 18.

Figure 4:
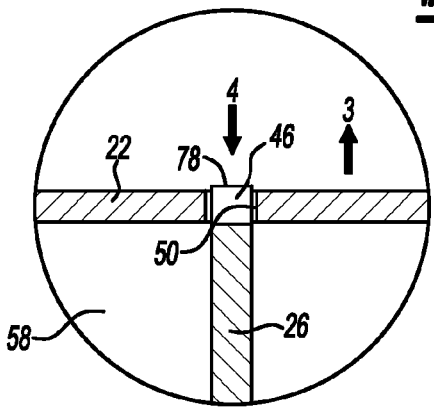
FIG. 4 shows a section view of a portion of the FIG. 1 assembly.
Figure 5:
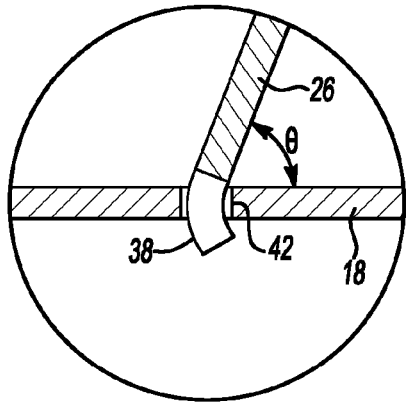
FIG. 5 shows a section view of a portion of the FIG. 3 assembly.
Figure 6:
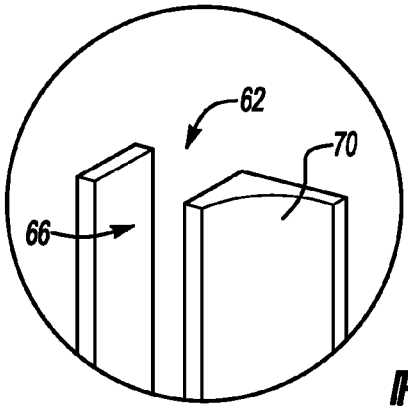
FIG. 6 shows a close-up view of a cleat of the FIG. 3 assembly.

In another installing position, the divider 26 is then rotated along path 2 about the curved extensions 38. The divider 26 is so long that the tabs 46 contact the second wall 22 after sufficient rotation. Continuing to rotate the divider 26 increases the distance between the first wall 18 and the second wall 22 by flexing the second wall 22 relatively away from the first wall 18 in direction 3. Flexing the second wall 22 establishes clearance enabling continued rotation of the divider 26 along path 2 until the tabs 46 are aligned for insertion into the apertures 50. Once aligned, the apertures 50 receive the tabs 46 as the second wall 22 slips back toward the first wall 18 in direction 4. The divider 26 is then in the engaged position with the housing 14 as shown in FIGS. 1 and 4, which establishes the two bin receiving areas 34. The first wall 18 and the second wall 22 limit movement of the divider 26 away from the engaged position.

In this example, the housing 14 includes a plurality of additional walls 54 that connect the first wall 18 to the second wall 22. The additional walls 54 strengthen the housing 14. The additional walls 54, the first wall 18, and the second wall 22 extend away from a base 58 or back wall. The base 58 also provides a mounting location for a cleat 62 that establishes a groove 66. When the divider 26 is in the engaged position, the groove 66 receives a portion of the divider 26. The cleat 62, a type of alignment feature, assists in holding the divider 26 in the engaged position.

In this example, a portion of the cleat 62 has a ramp profile 70. As the divider 26 moves along path 2 to the engaged position, a back edge portion 74 of the divider 26 moves against this ramp profile 70 and forces the base 58 to flex away from the divider 26 in direction 5. After sufficient movement along path 2, the back edge portion 74 aligns with the groove 66, which allows the divider 26 to slip into the groove 66 as the base 58 returns to an unflexed position.

In this example, the housing 14 comprises a plastic polystyrene material to accommodate flexing type movements of the second wall 22 and the base 58. In another example, the housing 14 comprises a more ridged material, and the divider 26, rather than the base 58, flexes as it moves to an engaged position. In such an example, the divider 26 comprises a plastic polystyrene material or another material suitable for enabling flexing.

The example tabs 46 each include a contact face 78 that contacts the second wall 22 as the divider 26 moves along path 2. In this example, the contact face 78 is not rounded, however other examples may include a rounding the contact face 78 to facilitate movement of the divider 26 along path 2.

Figure 7:
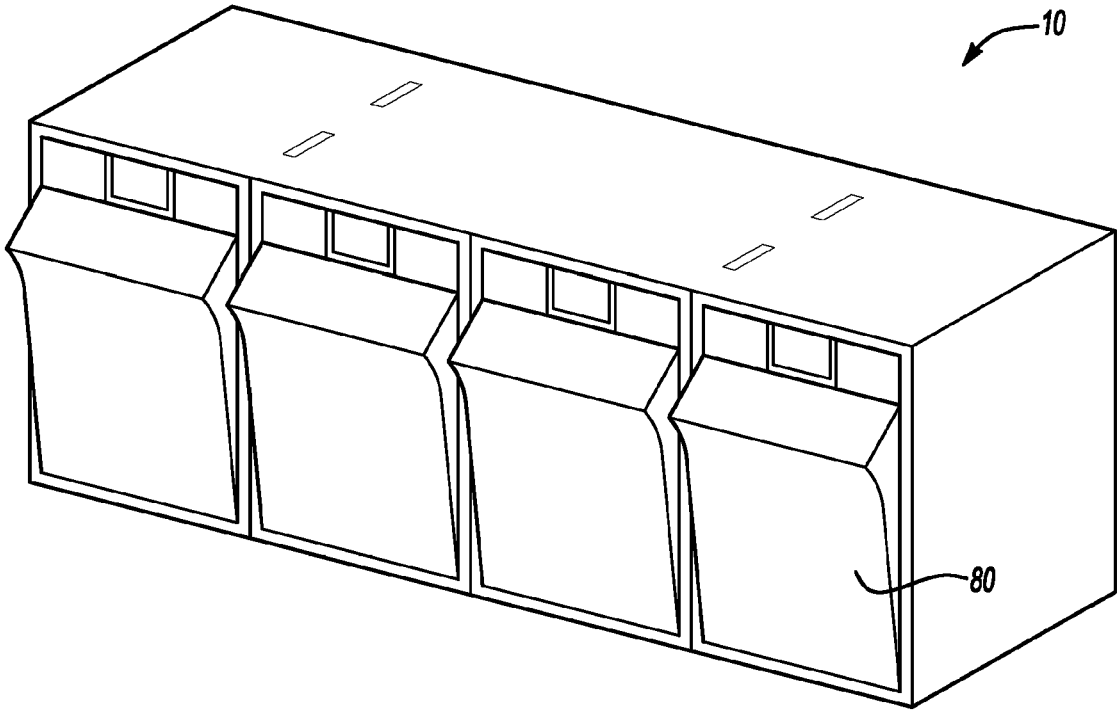
FIG. 7 shows a perspective view of the FIG. 1 display assembly with four individual display bins.
Figure 8:
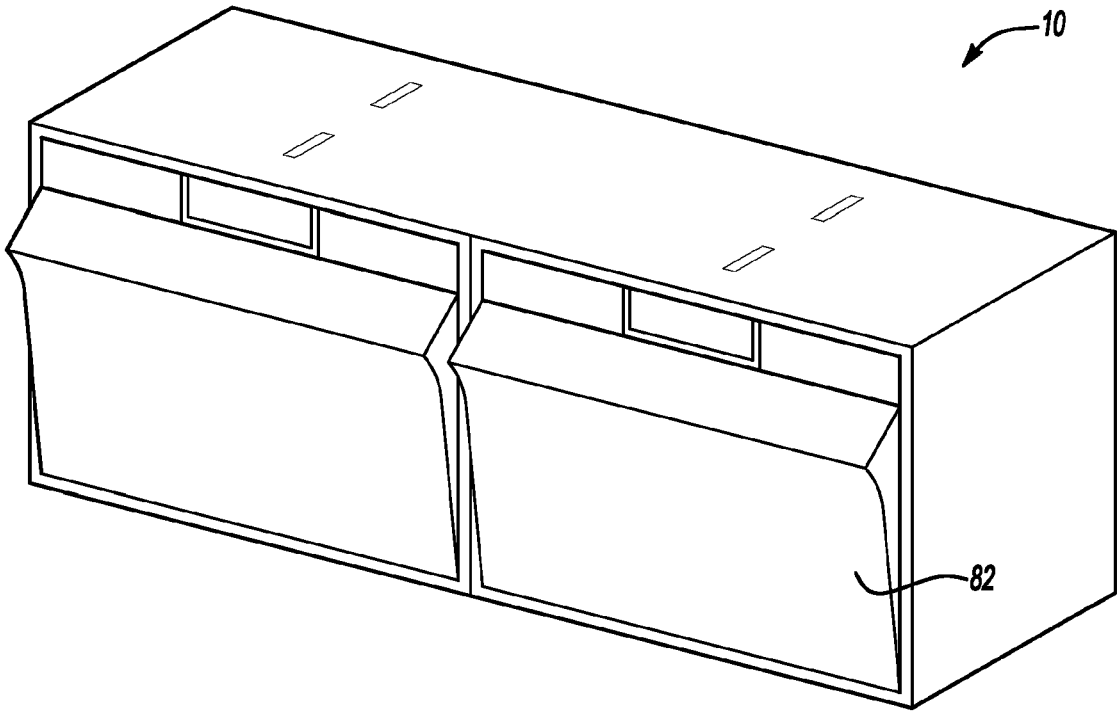
FIG. 8 shows a perspective view of the FIG. 1 display assembly with two individual display bins.

In one example, removing the divider 26 enables a user to reconfigure the display bin assembly 10 of FIG. 7, which incorporates four bins 80 having a width $W_2$, into the display bin assembly 10 of FIG. 8, which incorporates two bins 82 having the width $W_1$.

Although an embodiment of this invention has been disclosed, a worker of ordinary skill in this art would recognize that certain modifications would come within the scope of this invention. For that reason, the following claims should be studied to determine the true scope and content of this invention.

We claim:

1. A configurable display assembly, comprising:

a housing having a base portion, a first wall and an opposing second wall extending away from the base portion; and at least one divider moveable between an engaged position and a disengaged position, the divider spanning from the first wall to the second wall in the engaged position, at least one of the housing or the divider flexes to establish clearance for moving the divider to the engaged position and wherein an alignment feature engageable with the divider is mounted to the base portion and wherein the alignment feature is a cleat, and the at least one divider is rotatable into a groove defined by the cleat, wherein the housing and the divider establish at least one first bin receiving area when the divider is in the engaged position, wherein a first distance between the first wall and the second wall when the first wall is not flexed relative to the second wall is less than a length of the divider, and the first wall is configured to flex relatively away from the second wall to provide a second distance between the first wall and the second wall greater than a width of the divider.

2. The configurable display assembly of claim 1, wherein the cleat has a ramp profile facing outward from the groove, the ramp profile configured to guide the divider into the groove when the divider moves from the disengaged position to the engaged position.

3. The configurable display assembly of claim 1, including at least one curved extension of the divider, the at least one curved extension configured to engage at least one aperture established within the first wall to hold the at least one divider in the engaged position, wherein the curved extension extends through the aperture from a first surface of the first wall that faces the divider to an oppositely facing second surface of the first wall when the divider is in the engaged position; and wherein the at least one curved extension is spaced from the second surface of the first wall when the divider is in the engaged position.

4. The configurable display assembly of claim 1, wherein the at least one divider is supported exclusively by the alignment feature, the first wall, and the second wall.

5. The configurable display assembly of claim 1, including at least one tab of the divider, each at least one tab configured to engage a corresponding aperture established within the second wall, the at least one tab having a rounded contact face that contacts the second wall when the at least one divider is moved from the disengaged position to the engaged position.

6. The configurable display assembly of claim 1, wherein the divider rotates about an axis that aligned with the first wall and the second wall when the divider is moved from the disengaged position to the engaged position.

7. An adjustable display bin assembly comprising:

a first wall;

a second wall spaced a first distance from the first wall;

a base portion, wherein the first wall and the second wall extending away from the base portion;

a divider moveable between an engaged position and a disengaged position, the divider spanning and extending further than the first distance to engage the first wall and the second wall when in the engaged position said divider having a length greater than said first distance;

a first end of the divider having a tab configured to be received within a corresponding aperture established in the first wall; and a second end of the divider having an extension configured to be received within a corresponding aperture established in the second wall, wherein the first wall and the second wall establish a first display bin receiving area when the divider is in the disengaged position, and the first wall, the second wall, and the divider establish at least one second display bin receiving area when the divider is in the engaged position, wherein the first wall flexes relatively away from the second wall to provide clearance to align the tab to be received within the corresponding aperture established in the first wall wherein the divider rotates about an axis that aligned with the first wall and the second wall when the divider is moved from the disengaged position to the engaged position; wherein an alignment feature engageable with the divider is mounted to the base portion and wherein the alignment feature is a cleat, and the divider is rotatable into a groove defined by the cleat.

8. The adjustable display bin assembly of claim 7, wherein the divider rotates about the second end to force the tab against the first wall and flex the first wall relative to the second wall.

9. The adjustable display bin assembly of claim 7, wherein the extension comprises a curved extension.

10. The adjustable display bin assembly of claim 7, wherein the tab has a rounded contact face that contacts the first wall when the divider is moved from the disengaged position to the engaged position.

11. The adjustable display bin assembly of claim 7, wherein the extension is a curved extension that extends through the aperture from a first surface of the first wall that faces the divider past all portions of an oppositely facing second surface of the first wall when the divider is in the engaged position.

12. The adjustable display bin assembly of claim 7 wherein said extension extends all the way through said corresponding aperture thereto.

13. A method of installing a display bin divider, comprising:

inserting a first end of a divider into an aperture established in a first wall of a display bin wherein the first end includes a curved extension that is inserted further into the aperture as the divider is rotated about the first end;

rotating the divider about the first end; and flexing a second wall of the display bin away from the first wall to provide clearance for moving at least one tab on an opposing, second end of the divider into a position for insertion into a corresponding at least one aperture in the second wall and moving the divider against a ramped portion of a cleat to move the base portion away from the divider.

* * * * *